US008127825B2

(12) United States Patent
Ebetshuber

(10) Patent No.: US 8,127,825 B2
(45) Date of Patent: Mar. 6, 2012

(54) CASTING TOOL AND METHOD FOR PRODUCING WORKPIECES CAST FROM LIGHT-METAL ALLOYS

(75) Inventor: Manfred Johannes Ebetshuber, Gurten (AT)

(73) Assignee: Austria Alu-Guss Gesellschaft m.b.H., Braunau-Ranshofen (AT)

( * ) Notice: Subject to any disclaimer, the term of this patent is extended or adjusted under 35 U.S.C. 154(b) by 0 days.

(21) Appl. No.: 13/027,311

(22) Filed: Feb. 15, 2011

(65) Prior Publication Data

US 2011/0132566 A1 Jun. 9, 2011

Related U.S. Application Data

(62) Division of application No. 11/577,665, filed as application No. PCT/AT2005/000411 on Oct. 17, 2005, now Pat. No. 7,909,084.

(30) Foreign Application Priority Data

Oct. 21, 2004 (AT) ..... A 1771/2004

(51) Int. Cl.
*B22D 17/24* (2006.01)
*B22D 33/04* (2006.01)

(52) U.S. Cl. ..... 164/340; 164/334; 164/137

(58) Field of Classification Search ..... 164/30, 164/32, 112, 137, 334, 339, 340
See application file for complete search history.

(56) References Cited

U.S. PATENT DOCUMENTS

| | | | |
|---|---|---|---|
| 4,913,217 | A | 4/1990 | Koch et al. |
| 5,392,841 | A | 2/1995 | Anderson |
| 5,992,500 | A | 11/1999 | Schneider |
| 6,758,533 | B1 | 7/2004 | Hummel et al. |
| 7,909,084 | B2 | 3/2011 | Ebetshuber |
| 2001/0008182 | A1 | 7/2001 | Sugita et al. |
| 2004/0099398 | A1 | 5/2004 | Meyer |

FOREIGN PATENT DOCUMENTS

| | | | |
|---|---|---|---|
| AT | 409 728 | | 10/2002 |
| DE | 4201278 | | 7/1993 |
| EP | 0922 591 | | 6/1999 |
| EP | 1 116 536 | | 7/2001 |
| JP | 56 1450 | | 2/1981 |
| JP | 56014050 | A * | 2/1981 |
| JP | 01 138050 | | 5/1989 |
| JP | 01 241369 | | 9/1989 |
| WO | 01/66283 | | 9/2001 |
| WO | WO 0166283 | A1 * | 9/2001 |

* cited by examiner

*Primary Examiner* — Jessica L Ward
*Assistant Examiner* — Kevin E Yoon
(74) *Attorney, Agent, or Firm* — Greenblum & Bernstein, P.L.C.

(57) ABSTRACT

The invention relates to a casting tool for producing workpieces from light metal alloys. The system includes a positioning element, a core part, a first mold part structured to carry the positioning element and be movable toward the core part, and a core part support structured to support the core part. The system also includes at least one stop structured to limit movement of the front mold part toward the core part and to allow the positioning element to be introduced into the core part, whereby the positioning element holds the core part in a predetermined position for casting.

27 Claims, 3 Drawing Sheets

CASTING TOOL AND METHOD FOR PRODUCING WORKPIECES CAST FROM LIGHT-METAL ALLOYS

CROSS-REFERENCE TO RELATED APPLICATIONS

The present application is a divisional application of U.S. patent application Ser. No. 11/577,665 filed Apr. 20, 2007, which application is a U.S. National Stage of International Patent Application No. PCT/AT2005/000411 filed Oct. 17, 2005 and published as WO 2006/042350 on Apr. 27, 2006, and claims priority under 35 U.S.C. §119 of Austrian Patent Application No. A 1771/2004 filed Oct. 21, 2004.

BACKGROUND OF THE INVENTION

1. Field of the Invention

The invention relates to a casting tool for the production of workpieces cast from light-metal alloys and, in particular for the motor vehicle industry, wherein at least one positioning element is provided to fix at least one preformed core part remaining in the cast workpiece in a predetermined position within the casting tool, as well as a method for producing workpieces cast from light-metal alloys having at least one preformed core part remaining in the cast workpiece is held in a predetermined position within a casting tool.

2. Discussion of Background Information

For the production of workpieces from light-metal alloys, it is already known to hold preformed core parts in a casting tool with the aid of positioning elements, such that a light-metal alloy melt can be cast around the core parts.

From EP 0 922 591 A, a rim made of a light-metal alloy is known, for instance, wherein a core part comprises fixedly arranged positioning elements in order to be positioned within the mold. Such positioning elements arranged in the core part, however, have relatively large peripheries, thus forming weak material points such that very high stress peaks will occur in those regions of the rim under load, in particular under dynamic bending and torsional stresses.

A similar casting method has already become known from WO 01/66283 A1 and AT 409 728 B, respectively, wherein fixedly arranged positioning elements are likewise provided in the core part. These positioning elements comprise air discharge channels for the escape of expanded air. This method, however, involves high expenditures in terms of manufacturing technology, with equally high stress peaks occurring because of the positioning elements being fixedly arranged in the cores part.

From US 2004/0099398 A1, a positioning element for a sand core is known, wherein the positioning element is fixed within the sand core during the production of the latter, and via which a connection with the casting tool can be created.

DE 42 01 278 A1 describes supports or positioning elements for stabilizing casting cores in the production of molded articles. There, the pin-shaped positioning elements, which are fastened in the casting tool in the manner of a nail, each comprise a cast-in element extending transversely to the longitudinal direction of the shaft of the positioning element, which is firmly melted in the molded article to provide a firm connection of the positioning element in the molded article to be cast.

Furthermore, it is also known to form hollow spaces during the production of cast workpieces by the aid of core parts which will again be removed from the cast workpiece, such as, sand cores. Yet, comparatively large openings are required to remove the same, for which reason high stress peaks will again occur in the region of such openings.

SUMMARY OF THE INVENTION

An aspect of the present invention is to provide a cast workpiece as well as a method for producing workpieces cast from light-metal alloys, in which high stress peaks caused by positioning elements are avoided. In addition, an exact positioning of the core parts is to be ensured and a comparatively high construction freedom in the production of the workpieces is to be enabled.

With the initially defined kind of casting tool, this aspect is achieved by having at least one pin-shaped positioning element which tapers towards its free end, be fastened to the casting tool in a manner that the core part is held in a predetermined position during casting and the positioning element is removed from the workpiece upon completion of the same. By the aid of freely cantilevering, pin-shaped positioning elements, which are fastened to the casting tool, it has become feasible to hold the core part(s) of the light-metal workpiece to be produced reliably in a predetermined position within the casting tool. However, after the removal of the positioning elements, only comparatively small openings or indentations will remain in the core part or in the light metal surrounding the core part on that site on which a positioning element has penetrated the core part during the casting process, so that the completed light-metal workpiece will only exhibit comparatively reduced stress peaks in the region of the positioning elements. In principle, any desired workpieces can be produced from light-metal alloys, in particular aluminum-containing light-metal alloys, by the casting tool, wherein a high demand of light-metal workpieces exists. In particular, the casting tool can be used in the motor vehicle industry to produce, in particular, light-metal wheels or rims as well as longitudinal and transverse links, subframe parts, various types of braces as well as components for wheel suspensions and the like. Due to the low stress peaks enabled by the pin-shaped positioning elements fastened to the casting tool, the workpieces produced using the casting tool according to the invention are particularly well suited for exposure to dynamic bending and torsional forces.

In order to facilitate the penetration of the positioning elements into the core part, it is beneficial if the pin-shaped positioning element is designed to be at least partially conical.

It is, in particular, favorable, if the pin-shaped positioning element comprises a conical tip portion. This enables the core part to be "impaled" in a simple manner while, at the same time, a very small impression will be left in the core part after having removed the positioning element, whereby the stress peaks in the finished light-metal workpiece will again be kept low.

Tests have demonstrated that the positioning element will readily penetrate into the core part while, at the same time, achieving a reliable frictional engagement between the pin-shaped positioning element and the core part, if the conical tip portion has an opening angle of between 10° and 30° and, in particular, substantially 20°.

In order to hold the core parts on the positioning elements by frictional engagement, it is beneficial if a cylindrical subportion follows the conical end portion.

Tests have further demonstrated that the core part will be reliably held in its predetermined position within the casting tool while, at the same time, leaving a relatively small impression in the core part and in the light-metal alloy enclosing the core part after the removal of the positioning element, if the cylindrical subportion has a diameter smaller than 3 mm, preferably smaller than 2 mm and, in particular, of substantially 1.6 mm.

In order to remove pin-shaped positioning elements from the finished light-metal workpiece in a simple manner, it is advantageous if a conical subportion follows the cylindrical subportion.

Tests have demonstrated that, in this respect, it is particularly favorable if the conical subportion has an opening angle of between 5° and 15° and, in particular, substantially 10°.

In order to fasten the pin-shaped positioning element to the casting tool in a simple manner, it is advantageous if the pin-shaped positioning element comprises a fastening portion having a larger periphery than the cylindrical and/or conical subportion.

If the fastening portion, in the fastened state of the positioning element, is received in a recess within the casting tool, then only the positioning element portions having comparatively smaller peripheries will project into the core part, or into the light-metal alloy surrounding the core part.

In order to be able to insert the fastening portion into the recess of the casting tool in a simple manner, and to achieve a frictionally engaged fixation of the fastening portion in the recess of the casting tool, it is beneficial if the fastening portion tapers slightly conically to the end of the pin-shaped positioning element, located opposite the front tip portion.

In order to reliably fasten the pin-shaped positioning element in the casting tool, it is advantageous if the positioning element is fixed in a recess of the casting tool in a frictionally engaged manner or via an adhesive connection. Instead of the frictionally engaged or adhesive connection, a screwing, soldering or welding connection or a form-fit connection may, of course, also be provided to fix the positioning element in the casting tool.

In order to enable a simple closure of the casting tool and to fix the core part with the aid of the pin-shaped positioning element in a predetermined position within the casting tool, it is favorable if the casting tool comprises at least two relatively movable mold parts. Additionally, having the pin-shaped positioning element fixed in a movably mounted mold part, preferably the upper mold part.

In order to prevent the penetration of the positioning elements into the core part beyond a predetermined penetration depth, it is advantageous if a movable core part support includes at least one stop limiting the downward travel of the movable mold part is provided.

If the core part support is immersibly arranged in the fixedly arranged, lower mold part, the core part support can be removed from the casting tool in a simple manner after the core part is fixed to the positioning element.

If the core part support is resiliently mounted on a carrier, possible unevennesses can advantageously be compensated for when lowering the upper mold part.

In order to enable the self-centering of the core part support and, hence, ensure the exact positioning of the core part within the casting tool such that the positioning elements will reliably penetrate into the core part on the desired site, it is favorable if the carrier of the core part support is displaceably mounted in guides of a mold part by way of centering pins.

The method of the initially defined kind is characterized in that a positioning element fastened to the casting tool is introduced into the core part. The core part is held in frictional engagement by the positioning element during casting, and the positioning element is removed from the workpiece upon completion of the same. The achieved advantageous effects are set out above in connection with the casting tool according to the invention so as to avoid repetitions.

In respect to the technically simple fixation of the core part at a predetermined position within the casting tool, it is favorable if a movable mold part carrying the positioning element of the casting tool is moved towards the core part resting on a core part support. The frictionally engaged connection between the core part and the positioning element can be moved towards the core part as far as to a stop, before the core part support is removed from the casting tool.

If the core part has a lower density than the light-metal alloy, a cast workpiece having a low weight compared to a workpiece cast in one piece from the light-metal alloy will be produced in a simple manner. The core part in this case may, in particular, be comprised of a metal foam, e.g. aluminum foam, or also of a compact made of a porous silicate material, e.g., vermiculite, or the like.

In order to increase the strength of the workpiece cast from the light-metal alloy, it is advantageous if the core part has a higher density than the light-metal alloy. The core part in this case may, in particular, be comprised of steel or the like.

BRIEF DESCRIPTION OF THE DRAWINGS

In the following, the invention will be explained in even more detail by way of a preferred exemplary embodiment illustrated in the drawing, to which it is, however, not to be restricted. In detail, in the drawing.

DETAILED DESCRIPTION OF THE PRESENT INVENTION

Figure 1:
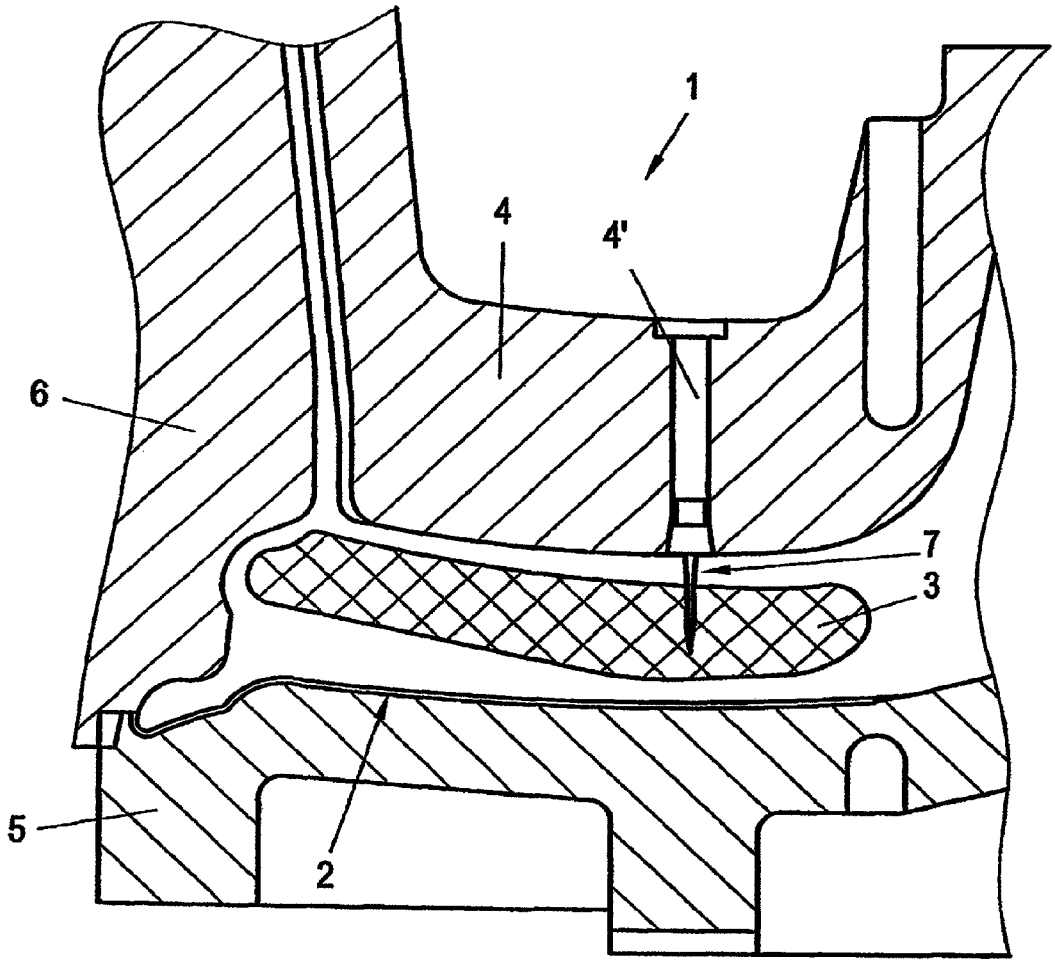
FIG. 1 depicts a cross section through a part of a casting tool with a core part introduced therein.

FIG. 1 is a partial illustration of a casting tool 1 for the production of a light-metal rim 2, in which a core part 3 is provided, which has a lower density than the light-metal alloy cast around the core part. The core part 3 could, for instance, be comprised of a metal foam, in particular aluminum foam, or also of a compact made of a porous silicate material, e.g. vermiculite, or even of a steel ring or the like.

The casting tool 1 is substantially composed of a movable mold upper part 4 and a fixedly arranged mold lower part 5 as well as lateral core slides 6. The core slides 6 may, for instance, be comprised of four quarter-circularly shaped individual parts which are displaced from outside radially towards inside for abutment on the mold lower part 5 upon closure of the casting tool 1.

The mold upper part 4 includes a recess 4', in which a pin-shaped positioning element 7, which is preferably made of steel, is fastened by the aid of an adhesive connection. The pin-shaped positioning element 7 serves to hold the core part 3 in a predetermined position within the casting tool 1 so as to enable the liquid light-metal alloy to be cast around the core part 3 as the former is being introduced into the casting tool. After having completed the casting procedure, the movably mounted mold upper part 4 is again displaced upwardly and the pin-shaped positioning element 7 is, thus, pulled out of the core part 3 and the light-metal alloy surrounding the core part. Because of the relatively small diameter of the pin-shaped positioning element 7, only a comparatively small opening will, thus, remain in the light-metal alloy 2 and in the core part 3, such that substantially smaller stress peaks will occur in the finished workpiece under load than with known positioning elements, which are fixedly positioned within the core part 3.

Figure 2:
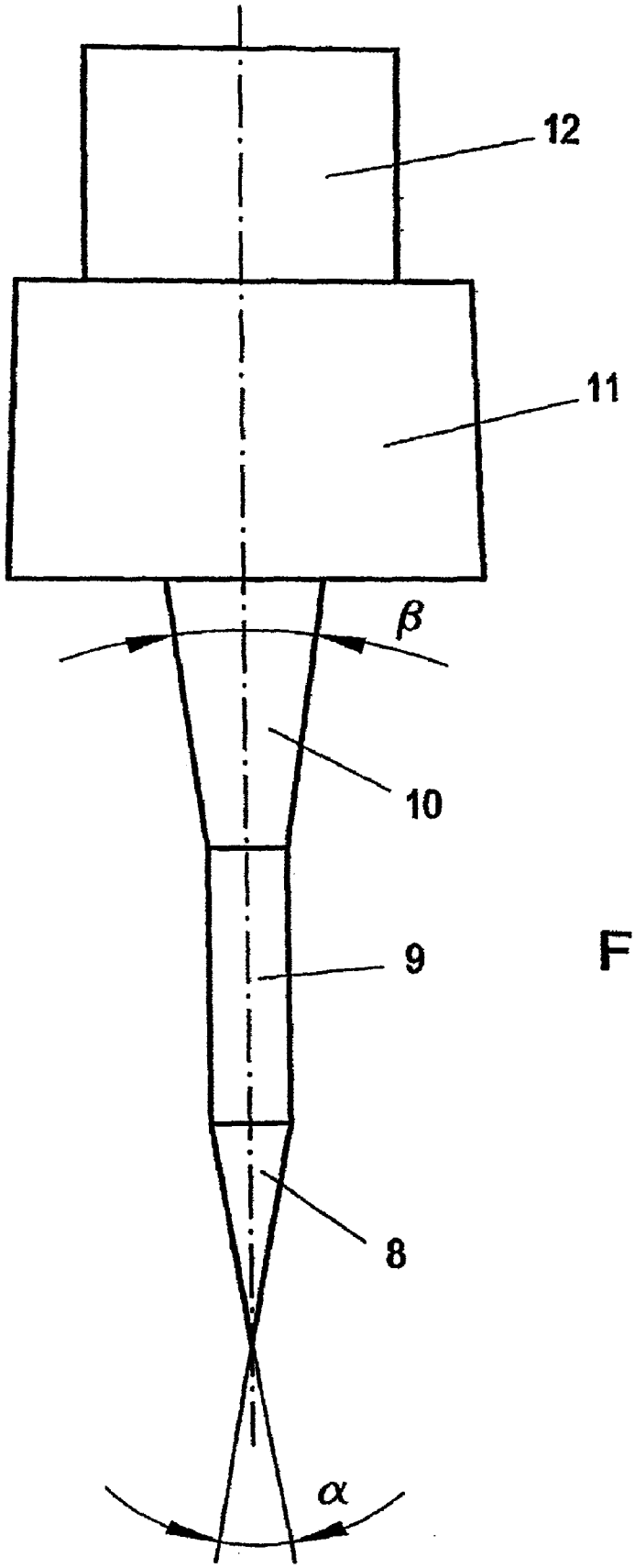
FIG. 2 is a detailed view of a pin-shaped positioning element.

FIG. 2 depicts the pin-shaped positioning element 7 in detail. It is, in particular, apparent that a conical tip portion 8 is to simply penetrate into the core part 3. In the exemplary embodiment illustrated, an opening angle $\alpha$ of about 20° is provided.

The tip portion 8 is joined by a cylindrical portion 9 which, as is apparent from FIG. 1, is also received in the interior of the core part 3 in the position penetrated into the core part 3. In order to keep the stress peaks of the light-metal workpiece as low as possible after the removal of the positioning element, the cylindrical portion 9 has a diameter as small as possible. A diameter of about 1.6 mm is provided in the illustrated exemplary embodiment.

The cylindrical subportion 9 is joined by a conical subportion 10 having an opening angle 13 of about 10°. As is apparent from FIG. 1, this conical subportion 10 is surrounded by the light-metal alloy during the casting of the light-metal workpiece and removed from the former upon completion of the workpiece.

The conical subportion 10 is joined by a fastening portion 11 via a step-like diameter expansion, wherein the fastening portion is intended to be received in a recess 4', of the casting tool 1. In order to provide for a simple introduction into the recess 4' as well as a certain frictional engagement between the fastening portion 11 and the recess 4', the fastening portion 11 is designed to be slightly conical. The fastening portion 11 is then joined by an end portion 12, which has a smaller diameter than the fastening portion 11 such that an adhesive will be able to reliably penetrate between the end portion 12 and the recess 4' of the casting tool 1.

Figure 3:
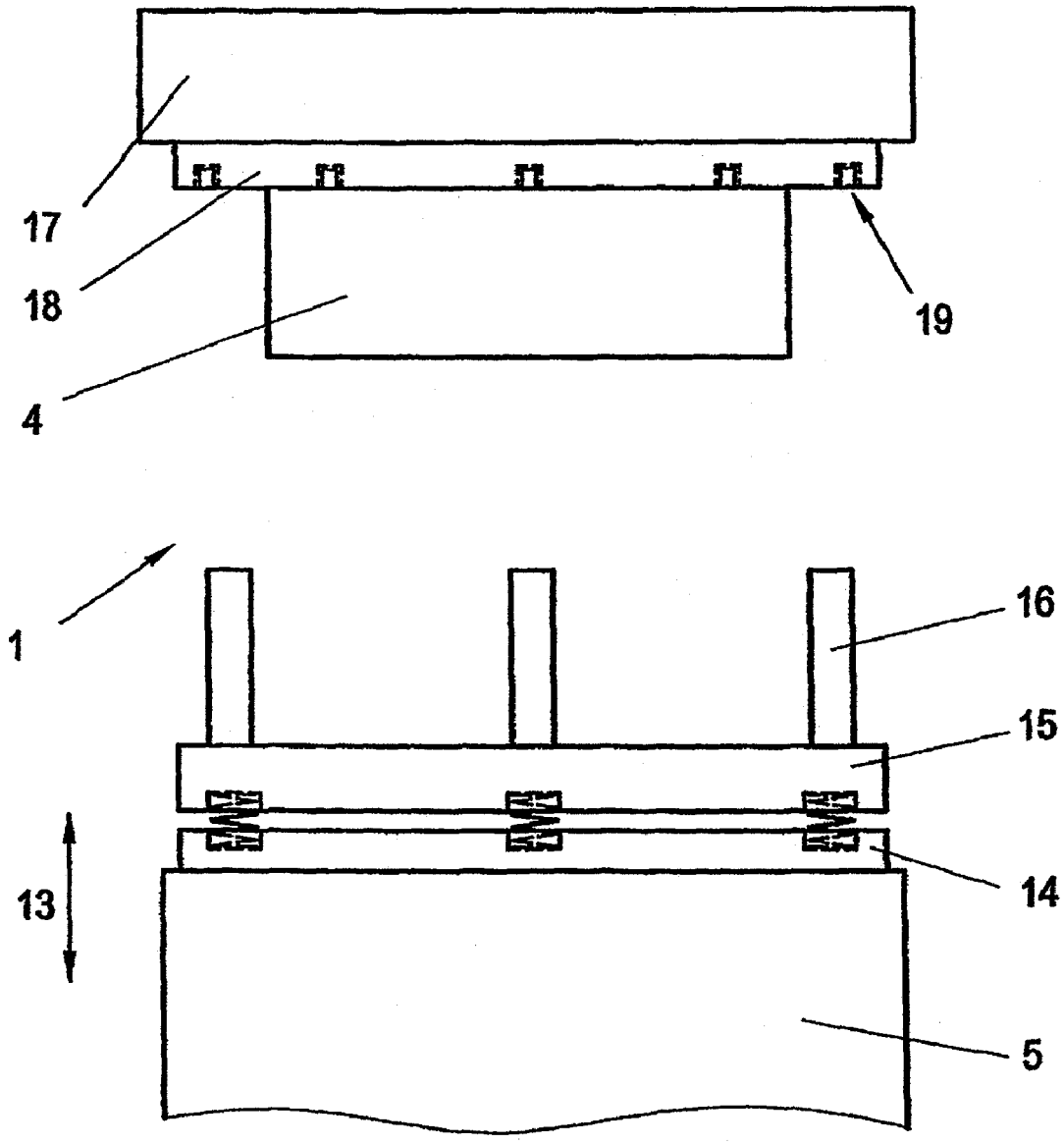
FIG. 3 is a schematic view of a casting tool for the production of a light-metal workpiece with the insertion of a core part resting on a core part support.

FIG. 3 depicts a schematic view of the casting tool 1, wherein a carrier 14 capable of being vertically displaced in the sense of arrow 13 and immersibly mounted in the mold lower part 5 is to be seen, in particular. A plate-shaped core part support 15 is resiliently mounted on the carrier 14 in order to compensate for possible unevennesses during the lowering of the mold upper part 4. Column-shaped stops 16 are provided on the core part support 15 and, during the reception of the core part 3, serve to adjust the desired distance relative to the mold upper part 4, which is pushed down by a carrier plate 17. When designing the height of the stops 16, a measure is adjusted such that the pin-shaped positioning elements 7 (as illustrated in FIG. 1) will reliably penetrate into the core part 3, i.e. "impale" the core part 3, in order to hold the core part 3 in a predetermined position within the closed casting tool 1 after having lowered the carrier 14 and the core part support 15.

In an end region 18 flanged to the mold upper part 4, ejection pins 19 are provided in a conventional manner for the separation of the light-metal workpiece from the mold upper part 4.

In the preferred exemplary embodiment, reference was, thus, made to the production of a light-metal rim. It goes without saying that the casting tool according to the invention may, however, also be employed for the production of any other light-metal workpieces with core parts remaining in the cast workpiece. For instance, it may be employed in the production of wheel suspensions, longitudinal and transverse links, subframe parts, various types of braces and the like.

What is claimed:

1. A casting tool for producing workpieces from light metal alloys comprising:

a core part;

a first mold part structured to carry the positioning element and be movable toward the core part;

a positioning element fixed to the first mold part and having a conical tip portion;

a core part support structured to support the core part in preparation of casting and structured to be removable after the preparation of casting; and at least one stop structured to limit movement of the first mold part toward the core part and to allow, in the preparation of casting, the conical tip portion of the positioning element to pierce the core part that is supported by the core part support, whereby, after removal of the core part support, the positioning element holds the core part via friction in a predetermined position for casting after the preparation of casting, wherein the positioning element is removable from a produced workpiece when the produced workpiece casting is completed.

2. The casting tool of claim 1, further comprising a second mold part, which is structured to be movable relative to the first mold part.

3. The casting tool of claim 1, wherein the positioning element is pin-shaped and tapers towards a free end, wherein the free end is arranged to be fixed in the first mold part.

4. The casting tool of claim 1, wherein the workpieces are produced for use in motor vehicles.

5. The casting tool of claim 1, wherein the core part is preformed.

6. The casting tool of claim 2, wherein the core part support is immersibly arranged in the second mold part.

7. The casting tool of claim 6, wherein the second mold part is fixably located.

8. The casting tool of claim 1, wherein the movable core part support includes the at least one stop, which limits forward movement of the first mold part.

9. The casting tool of claim 1, wherein the core part support is resiliently mounted on a carrier.

10. The casting tool of claim 9, wherein the carrier is displaceably mounted in guides of at least one of the first mold part and the second mold part via at least one centering pin.

11. The casting tool of claim 1, wherein the positioning element is structured to be at least partially conical.

12. The casting tool of claim 1, wherein the positioning element comprises a conical tip.

13. The casting tool of claim 12, wherein the conical tip is arranged to have an opening angle between 10° and 30°.

14. The casting tool of claim 13, wherein the conical tip is arranged to have an opening angle of substantially 20°.

15. The casting tool of claim 12, wherein the positioning element further comprises a cylindrical subportion arranged to follow the conical tip.

16. The casting tool of claim 15, wherein the cylindrical subportion has a diameter smaller than 3 mm.

17. The casting tool of claim 15, wherein the cylindrical subportion has a diameter smaller than 2 mm.

18. The casting tool of claim 15, wherein the cylindrical subportion has a diameter of substantially 1.6 mm.

19. The casting tool of claim 15, wherein the positioning element further comprises a conical subportion arranged to follow the cylindrical subportion.

20. The casting tool of claim 19, wherein the conical subportion has an opening angle of between 5° and 15°.

21. The casting tool of claim 19, wherein the conical subportion has an opening angle of substantially 10°.

22. The casting tool of claim 19, wherein the positioning element further comprises a fastening portion structured to have a larger periphery than at least one of the cylindrical subportion and the conical subportion.

23. The casting tool of claim 22, further comprising a recess, wherein in a fastened state, the fastening portion is structured to be received in the recess.

24. The casting tool of claim 22, wherein the fastening portion tapers slightly conically to the end of the positioning element, which is located opposite the conical tip portion.

25. The casting tool of claim 1, further comprising a recess wherein the positioning element is fixably positioned in the recess in one of a frictionally engaged manner or via an adhesive connection.

26. A casting tool for producing workpieces from light metal alloys, comprising:

a core part support structured and arranged to support a core part;

a first mold part and a second mold part, which define a casting mold therebetween;

the first mold part being structured and arranged to move towards the second mold part;

the second mold part being fixedly arranged;

the first mold part comprising a positioning element fixed thereto;

the first mold part being structured and arranged to move towards the core part; and a conical tip portion of the positioning element being structured and arranged to pierce the supported core part as far as allowed by a stop arranged to limit movement of the first mold part, whereby the positioning element frictionally engages the core part, wherein the workpiece is castable in the casting tool while the core part is held by the positioning element in a predetermined position, and wherein the positioning element is removable from the workpiece after casting.

27. A casting tool for producing workpieces, comprising:

a core part support for supporting a core part;

a first mold part and a second mold part, which define a casting mold therebetween;

the first mold part being structured and arranged to move towards the second mold part;

the second mold part being fixedly arranged;

the first mold part comprising a positioning element;

the first mold part being structured and arranged to move towards the core part; and the positioning element being structured and arranged to frictionally engage the core part and comprising:

a conical tip portion structured and arranged to pierce the supported core part; and a stop arranged to limit movement of the first mold part;

wherein the workpiece is castable in the casting tool while the core part is held by the positioning element in a predetermined position, and wherein the positioning element is removable from the workpiece after casting.

* * * * *